United States Patent [19]

Triner et al.

[11] Patent Number: 4,514,030

[45] Date of Patent: Apr. 30, 1985

[54] SHORTING EDGE CONNECTOR

[75] Inventors: Irvin R. Triner, Stickney; John N. Martinowich, Warrenville, both of Ill.

[73] Assignee: Methode Electronics, Inc., Chicago, Ill.

[21] Appl. No.: 529,203

[22] Filed: Nov. 2, 1983

Related U.S. Application Data

[63] Continuation of Ser. No. 296,898, Aug. 27, 1981, abandoned.

[51] Int. Cl.[3] ..... H01R 9/09

[52] U.S. Cl. ..... 339/176 MP; 339/75 MP

[58] Field of Search ..... 339/176 MP, 176 MF, 339/75 MP

[56] References Cited

U.S. PATENT DOCUMENTS

| | | | |
|---|---|---|---|
| 3,289,146 | 11/1966 | Tuchel | 339/176 MP |
| 3,903,385 | 9/1975 | Moyer et al. | 339/176 MP |
| 4,087,151 | 5/1978 | Robert et al. | 339/176 MP |
| 4,106,841 | 8/1978 | Vladic | 339/176 MP |
| 4,285,565 | 8/1981 | Kirby | 339/176 MP |

FOREIGN PATENT DOCUMENTS

| | | | |
|---|---|---|---|
| 2802800 | 7/1978 | Fed. Rep. of Germany | 339/176 MP |

*Primary Examiner*—John McQuade

*Attorney, Agent, or Firm*—Charles F. Pigott, Jr.

[57] ABSTRACT

An edge connector having an opening for receiving a printed circuit board and having two opposed rows of contact for making electrical contact with conductive pads on opposite sides of a printed circuit board inserted into the connector. The connector is designed with the objective that when the two rows of contacts are in their "at rest" positions, the various contacts in one row will be in engagement with corresponding contacts in the opposed row at a location inwardly of the outer ends of the contacts, thereby electrically shorting the contact ends. The contacts of the connector are designed so that when a leading edge of a printed circuit board is inserted into the slot between the two opposed rows of contacts, such contacts will make electrical contact with conductive pads on both sides of the board, and after such contact is made, further insertion of the board will cause the contacts to separate at the location they had been shorted thereby completing a circuit through the board.

6 Claims, 6 Drawing Figures

SHORTING EDGE CONNECTOR

This is a continuation of application Ser. No. 296,898 filed Aug. 27, 1981, now abandoned.

BRIEF SUMMARY OF THE INVENTION

The electrical connector of the present invention may be termed a "make-before-break" connector, which means the contacts are normally shorted out, and insertion of the leading edge of a printed circuit board into the connector will separate opposing pairs of contacts at the location of the short between them only after the outer end portions of the contacts have made electrical contact with the conductive pads on the opposite sides of the board. In a similar fashion, when a printed circuit board is removed from the shorting edge connector, the contacts in one row will engage the contacts in an opposing row and cause shorting of the contacts before the conductive pads on the opposite sides of the board are disengaged from the outer end portions of the contacts.

Prior attempts have been made to design a "make-before-break" connector which will perform the functions described above. One such design is shown in U.S. Pat. No. 4,087,151. However, considerable problems have been encountered with most such prior attempts. The principal problem has been premature separation of the contacts at the point of shorting with the result that shorting is discontinued before the end portions of the contacts have made engagement with the conductive pads on the opposite sides of a printed circuit board.

In other words, when a board is inserted into a connector between two parallel rows of contacts, the board deflects the contacts in one row away from the contacts in the opposing row. Where such deflection causes the contacts to separate where they had been shorted out, before the ends of the contacts make good electrical engagement with the opposite sides of the printed circuit board, such a connector will not function in the desired manner.

It is an object of our invention to provide a switching connector where the opposed two rows of contacts will remain shorted out against one another until after the outer end portions of the contacts are in electrical contact with conductive pads on the opposite sides of the printed circuit board, and thereafter upon further insertion of the board, the contacts will be separated at the location of the short to complete a circuit through the board.

Another object of our invention is to provide an electrical edge connector of the type described above where each contact has three contact portions thereon which project toward a corresponding contact in an opposing row, one such contact portion being for the purpose of engagement with an opposing contact to effect shorting of the contacts, and the other two contact portions being disposed for engagement with the conductive pads on the sides of a printed circuit board inserted into the connector.

A still further one of our objects is to provide an electrical connector as last above-described where the outermost one of the three contact portions is mechanically "isolated" from the innermost one of the three contact portions, whereby insertion of a printed circuit board between a pair of opposed contacts at the location of the outermost contact portions will cause primarily only localized deflection and will not effect separation of the pair of contacts at the location of the innermost contact portions where they are shorted.

The foregoing and other objects and advantages of the invention will be apparent from the following description of a preferred embodiment, taken in conjunction with the accompanying drawings.

Figure 1:
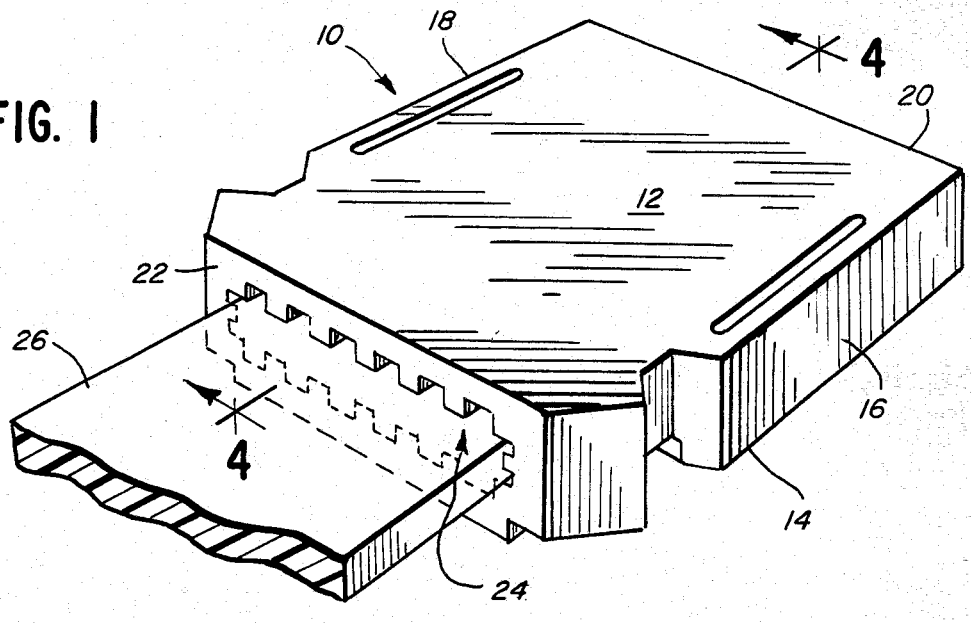
FIG. 1 is a perspective view of a switching edge connector constructed in accordance with the present invention, the connector being shown in conjunction with a fragmentary illustration of a printed circuit board inserted into a slot provided therefor in the connector.
Figure 2:
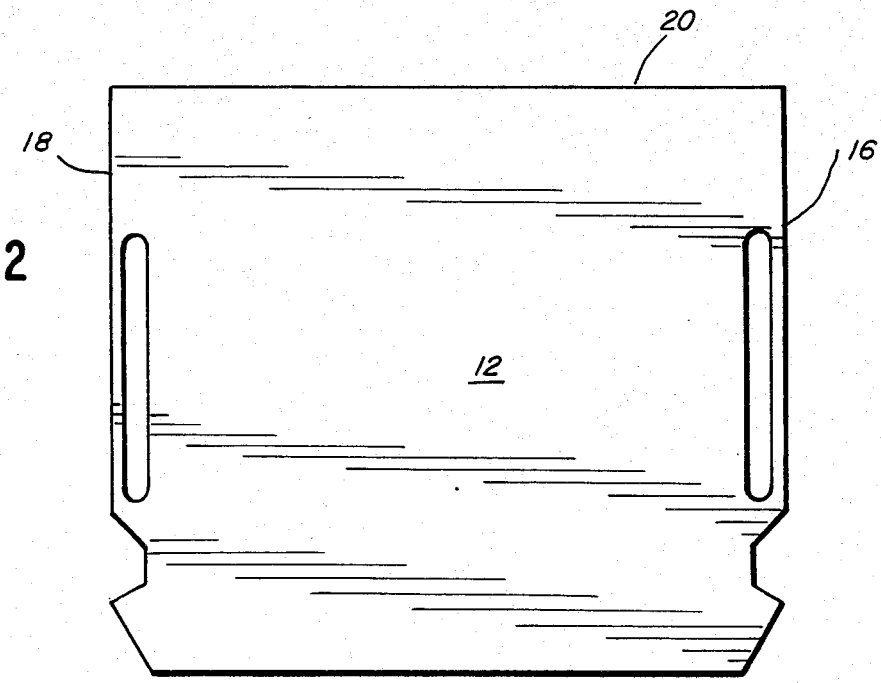
FIG. 2 is a top plan view of the edge connector of FIG. 1.

Now, in order to acquaint those skilled in the art with the manner of making and using our invention, we shall describe, in conjunction with the accompanying drawings, a preferred embodiment of the invention.

DETAILED DESCRIPTION OF THE INVENTION

Referring now to the drawings, there is shown a housing 10 of insulative material comprising a top wall 12, bottom wall 14, side walls 16 and 18, a back wall 20, and a front wall 22 which is provided with a slot 24 intended to receive the leading edge of a printed circuit board such as illustrated at 26.

Figure 3:
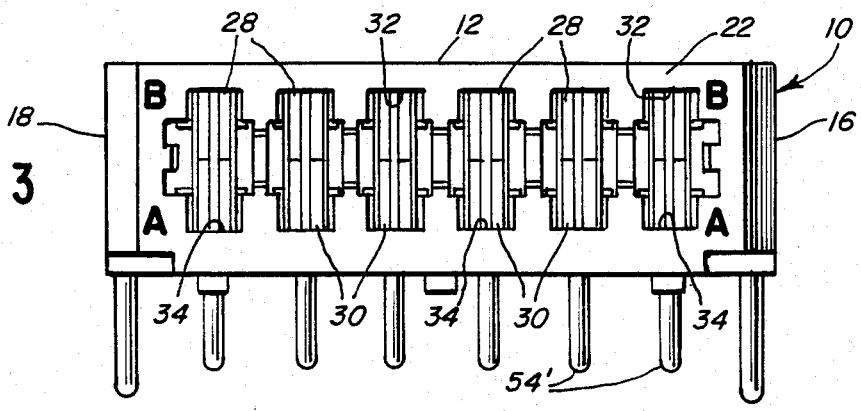
FIG. 3 is a front elevational view of the connector of FIG. 1 showing the slotted opening in the connector and the two rows of normally (closed) shorted contacts positioned therein.
Figure 4A:
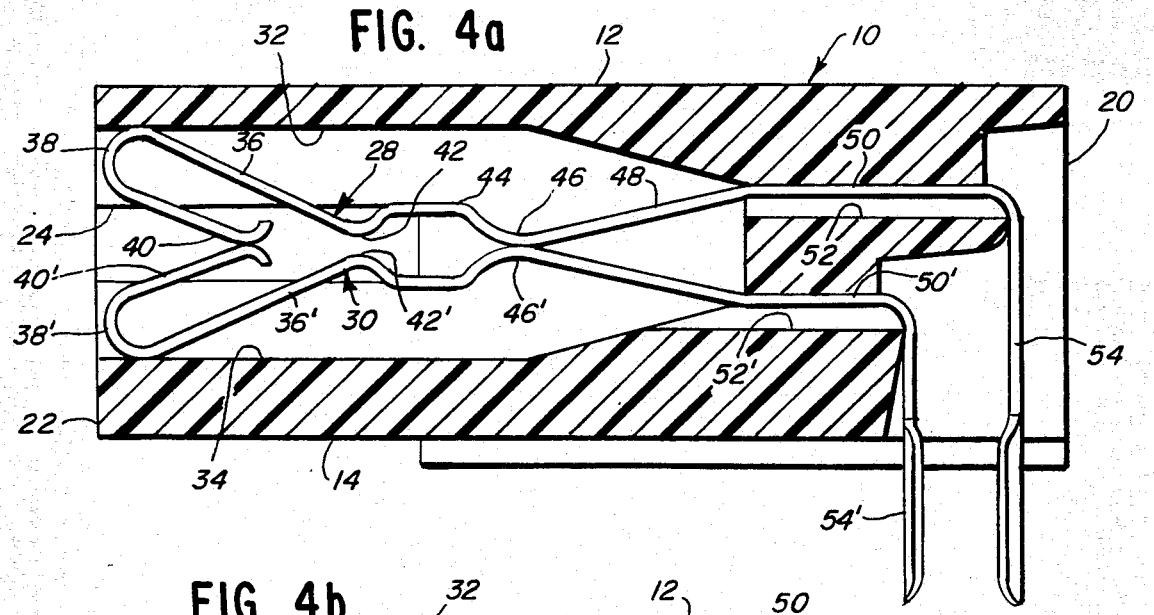
FIG. 4*a* is a sectional view taken approximately along the line 4—4 of FIG. 1 showing the connector contacts in their "at rest" positions with no printed circuit board positioned in the connector (normally closed—shorted)

FIG. 3 illustrates that in the embodiment being described there are provided one row of six aligned contacts 28 and a second row of six opposing contacts 30, each contact 28 when in its "at rest" position being in engagement with a corresponding opposing contact 30 as shown in FIG. 4*a* at 46, 46'.

In accordance with the present invention, the contacts 28 and 30 are three-point contacts, meaning each contact includes three projections intended to engage an opposing contact or to engage against conductive pads on the leading edge of a printed circuit board such as shown at 26 which is inserted into the connector slot 24.

FIG. 4*a* shows a pair of opposing contacts 28 and 30 mounted in the insulative housing 10 and disposed in their normal "at rest" position where they are engaged at two contact points. The housing 10 (see FIG. 3) includes six recesses or pockets 32 spaced apart and located on one side of the slot 24 to accommodate a row of six contacts 28, and a similar series of six recesses or pockets 34 disposed on the opposite side of the slot 24 to accommodate the opposing row of six contacts 30. As shown in FIG. 4*a*, each contact 28 is positioned in a corresponding pocket 32 with its outer end portion in communication with the board slot 24 and in engagement with an opposing contact 30 at 46, 46' when no board is positioned in the slot.

Each contact 28 includes an outer end portion 36 which is bent back on itself at 38 to form a free end portion 40 which projects inwardly (meaning from left to right as viewed in FIG. 4*a*) and also extends into the slot 24 toward the opposing contact 30 so as to engage the outer end of the latter in the absence of a board 26. Since the structure of the contact 30 is the same as the contact 28, except for a slightly different tail portion 54, corresponding primed reference numerals will be used to identify the contact 30.

Figure 4B:
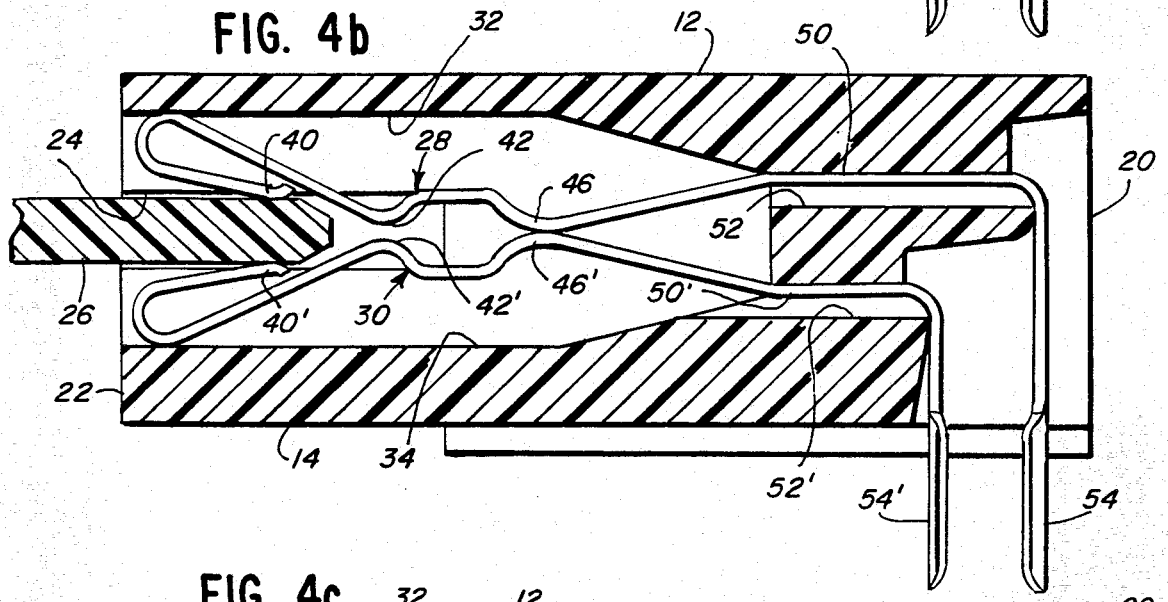
FIG. 4*b* is a sectional view similar to FIG. 4*a* showing the connector with the leading edge of a printed circuit board partially inserted therein, but with corresponding opposed contacts still engaged so as to provide a short circuit therebetween.
Figure 4C:
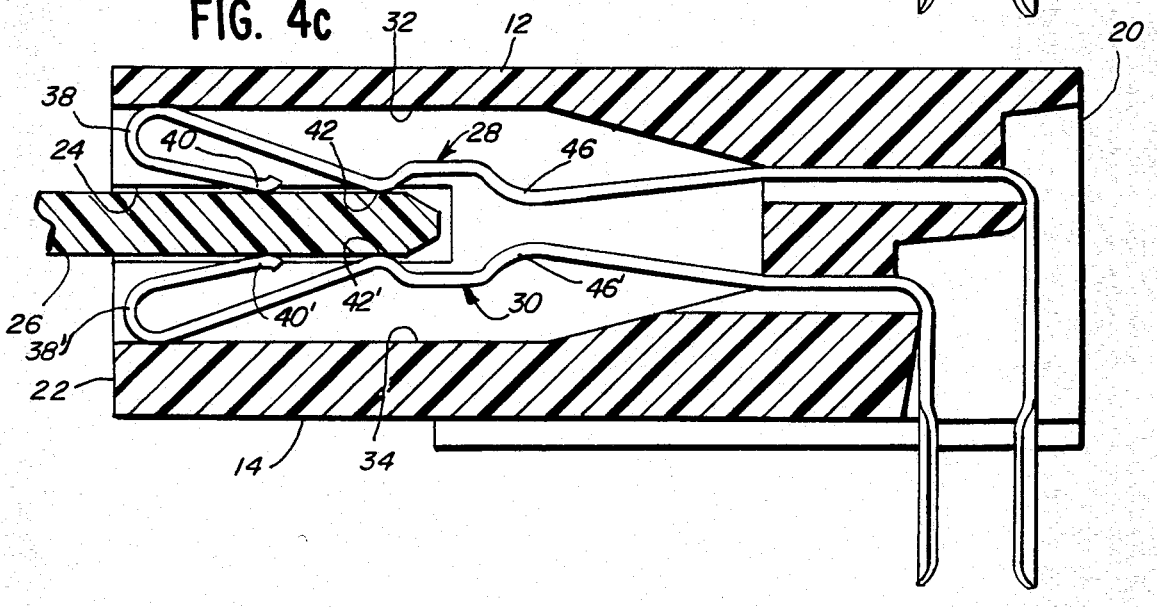
FIG. 4*c* is a further sectional view similar to FIG. 4*a* showing the leading edge of a printed circuit board substantially fully inserted into the connector, in which position the contacts in the connector are in electrical engagement with conductive pads on opposite sides of the board, and the corresponding opposed contacts are separated from one another to complete a circuit through the connector and circuit board.

It will thus be seen that the free end portion 40 of contact 28 comprises a first contact point which may engage a corresponding free end portion 40' of an opposed contact 30 as shown in FIG. 4*a* where there is no printed circuit board 26 inserted into the connector opening or slot 24. The outer end portion 36 of connector 28 also extends toward the opposing contact to form a projecting portion 42 which comprises a second contact point. As shown in FIG. 4*a*, the second opposing contact portions 42 and 42' do not engage one another, but when the edge of a printed circuit board 26 is inserted in slot 24, the contact portions 42 and 42' will engage conductive pads on the opposite sides of the board as shown in FIG. 4*c*.

The contact 28 is bent inwardly of the second contact point 42 to form a section 44, and it is then bent toward the opposing contact again at 46 to form a third contact point where the contact 28 is again in engagement with the opposing contact 30 in the absence of a board 26 in the slot 24. Inwardly of the third contact point 46, the contact 28 extends further inwardly at 48, and a portion 50 extends through an opening 52 in the housing 10. A bent tail portion 54 extends out of the housing 10 to provide a terminal.

It is important to note that as mounted in the pocket 32, contact 28 is supported at its outer end by the back wall of pocket 32. Thus, as shown in FIG. 4*a*, the upper end portion 36 of the contact is in engagement with the wall of pocket 32 in the area of bend 38 and is supported thereby. When the leading edge of a printed circuit board 26 is inserted into the slot 24 as shown in FIG. 4*b*, the outer contact portions 40 and 40' of contacts 28 and 30 are deflected toward the back walls of the respective pockets 32 and 34, but during such deflection the upper end portions of the contacts continue to be supported by the pocket walls. As a result, the deflection of the contacts tends to be localized. In other words, as shown in FIG. 4*b*, the deflection of the outer contact portions 40 and 40' of the contacts 28 and 30 caused by insertion of the printed circuit board to the position shown in FIG. 4*b* does not cause separation of the contacts at the innermost contact portions 46 and 46'. The latter innermost contact portions remain in engagement because of the localized nature of the deflection of the outer contact portions 40 and 40' of contacts 28 and 30.

The operation of the edge connector of the present invention will now be described. It will be assumed the various terminals 54 and 54' of the contacts 28 and 30 are connected to a power source. However, in the "at rest" position of the contacts as shown in FIG. 4*a*, there is two point contact or engagement between each contact 28 and its opposing contact 30. Such engagement occurs at the outer contact portions 40 and 40' which may be referred to as the first contact point, although these contact portions can be spaced apart if desired, and also at the projecting portions 46 and 46' which may be referred to as the third contact point. It will be understood that engagement of contacts 28 and 30 at the third contact portions 46 and 46' causes shorting of the contacts so that no power is conducted to the outer end portions of the contacts.

When the leading edge of a printed circuit board 26 is inserted partially into the slot 24 to the position shown in FIG. 4*b*, the outer contact portions 40 and 40' of the contacts 28 and 30 are deflected and they engage conductive pads formed on the opposite sides of the printed circuit board. However, while the contacts are thus in engagement at 40, 40' with the circuit on the sides of the board, it will be noted that despite the deflection of the outer end portions of the contacts, the projecting portions 46 and 46' are still in engagement and thus the contacts remain shorted.

As the printed circuit board 26 is inserted further into the slot 24 so as to engage and deflect the contact projecting portions 42 and 42', which may be referred to as the second contact point, the latter deflection causes the contacts to separate at the third projecting portions 46 and 46', and at that time the projecting portions 42 and 42' make contact with the circuitry on the sides of the board 26.

It will be seen that in the position shown in FIG. 4*c*, the contacts 28 and 30 each engage a corresponding side of the board 26 at two points, namely, at the first outer contact portions 40 and 40', and also at the second contact portions 42 and 42', thereby affording redundant contact with the board. In the position shown in FIG. 4*c*, the leading edge of the board 26 is approximately fully inserted into the slot 24, and since the contacts 28 and 30 are no longer shorted, a circuit is completed through the connector and board.

It will now be understood that the present invention affords an advantageous switching edge connector which maintains the two rows of contacts shorted out until full contact has been made on the sides of the printed circuit board by the outer contact portions 40 and 40'. The contacts are designed so that deflection of the outer contact portions 40 upon initial insertion of a board 26 provides only localized deflection as shown in FIG. 4*b* and thus does not break the engagement of the contact portions 46 and 46'. It is only after the board has been inserted to a depth where it engages and deflects the second projecting portions 42 and 42' that the third contact portions 46 and 46' are separated, and by the time that occurs the first portions 40 and 40' are in firm electrical contact with conductive pads on the opposite sides of the board 26, and engagement is also made shortly thereafter between the second projecting portions 42 and 42' and the sides of the board, thereby establishing redundant electrical contact with the board.

The contacts of the present invention are uniquely capable of localized deflection at the outer end portions due to the relatively extended outer portions 36, the bent back portions 40 which are bent into a U-shaped bend at 38, and because of the support afforded to the outer end portions by the back walls of the pockets 32 and 34 during deflection of those contact portions. Such support contributes substantially to the localized nature of the deflection of the outer portions of the contacts so as to assure that shorting of the two series of contacts is maintained until after the board is inserted beyond the position shown in FIG. 4*b* and the board engages and deflects the second projecting portions 42 and 42'.

When a printed circuit board 26 is withdrawn from the connector after having been inserted to the position of FIG. 4*c*, the two series of contacts 28 and 30 will again become shorted due to reengagement of contact portions 46 and 46' when the board is withdrawn to the position shown in FIG. 4*b*, but the first outer contact portions 40 and 40' will still be in firm engagement with conductive pads on the opposite sides of the board. Thereafter, upon further withdrawal of the board 26 from between the shorted series of contacts, the board is withdrawn from between the shorted outer contact portions 40 and 40' and removed from the connector.

What is claimed is:

1. In an edge connector of the type having an insulative housing with an opening therein for receiving an edge portion of a printed circuit board, and two series of contacts mounted in opposed relation in said housing for engagement with opposite sides of the leading edge of a board inserted in said opening to make electrical contact with circuitry on the sides of said board, the improvement comprising, in combination said series of contacts being a plurality of deflectable contacts arranged in opposed pairs, each contact having a first outer contact portion which projects into said opening toward the opposing contact and makes engagement with the adjacent side of the leading edge of a printed circuit board inserted in said opening, a second intermediate contact portion which projects into said opening toward the opposing contact and also makes separate spaced engagement with the adjacent side of the leading edge of a printed circuit board inserted in said opening after the leading edge of said board has deflected and moved past said first contact portion, and a third inner contact portion which projects toward the opposing contact, said contacts being formed so that at least the third inner contact portions of an opposing pair of contacts are in engagement in the absence of a board in said opening, thereby shorting said contacts until the leading edge of a board has been inserted in engagement with said second contact portions, the outer end portions of said contacts being made elongated and sufficiently flexible that insertion of the leading edge of a printed circuit board past said first contact portions will effect only localized deflection of said first contacts into engagement with adjacent side of the board whereby said third contact portions will remain engaged at least until said board engages and deflects said second contact portions, and said second contact portions being sufficiently proximate in spaced relation to said third contact portions that deflection of said second contact portions by the leading edge of a printed circuit board will cause said third contact portions to separate thereby completing a circuit through said board, said contacts being formed so that said first outer contact portions of an opposing pair of contacts are also in engagement in the absence of a board in said opening.

2. An improved edge connector as defined in claim 1 where the outer end of each contact is bent back on itself to form a generally U-shaped bend, said first contact portion comprising the free end portion of said bent outer end.

3. In an edge connector of the type having an insulative housing with an opening therein for receiving an edge portion of a printed circuit board, and two series of contacts mounted in opposed relation in said housing for engagement with opposite sides of the leading edge of a board inserted in said opening to make electrical contact with circuitry on the sides of said board, the improvement comprising, in combination, said series of contacts being a plurality of deflectable contacts arranged in opposed pairs, each contact having a first outer contact portion which projects into said opening toward the opposing contact and makes engagement with the adjacent side of the leading edge of a printed circuit board inserted in said opening, the outer end of each contact being bent back on itself to form a generally U-shaped bend and said first contact portion comprising the free end portion of said bent outer end, a second intermediate contact portion which projects into said opening toward the opposing contact and also makes separate engagement from said first outer contact with the adjacent side of the leading edge of a printed circuit board inserted in said opening after the leading edge of said board has deflected and moved past said first contact portion, and a third inner contact portion which projects toward the opposing contact, said contacts being formed so that said first outer and said third inner contact portions of an opposing pair of contacts are in engagement in the absence of a board in said opening thereby shorting said contacts until the leading edge of a board has been inserted in engagement with said second contact portions, said bent outer end portions of said contacts being made elongated and sufficiently flexible that insertion of the leading edge of a printed circuit board past said first contact portions will effect only localized deflection of said contacts whereby said third contact portions will remain engaged at least until the leading edge of said board engages and deflects said second contact portions, and said second contact portions being sufficiently proximate said third contact portions that deflection of said second contact portions by the leading edge of a printed circuit board will cause said third contact portions to separate thereby completing a circuit through said board.

4. An improved edge connector as defined in claim 3 where each contact is mounted in a corresponding pocket in said insulative housing, said pocket including a supporting wall which supports the outer end of a contact in an area proximate said U-shaped bend when said free end portion is deflected by the leading edge of a printed circuit board inserted in said opening thereby causing such deflection to be localized.

5. In an edge connector of the type having an insulative housing with an opening therein for receiving an edge portion of a printed circuit board, and two series of contacts mounted in opposed relation in said housing for engagement with opposite sides of the leading edge of a board inserted in said opening to make electrical contact with circuitry on the sides of said board, the improvement comprising, in combination, said series of contacts being a plurality of deflectable contacts arranged in opposed pairs, each contact having a first outer contact portion which projects into said opening toward the opposing contact and makes engagement with the adjacent side of the leading edge of a printed circuit board inserted in said opening, a second intermediate contact portion which projects into said opening toward the opposing contact and also makes engagement with the adjacent side of the leading edge of a printed circuit board inserted in said opening after the leading edge of said board has deflected and moved past said first contact portion, and a third inner contact portion which projects toward the opposing contact, said contacts being formed so that at least the third inner contact portions of an opposing pair of contacts are in engagement in the absence of a board in said opening, thereby shorting said contacts until the leading edge of a board has been inserted in engagement with said second contact portions, the outer end of each contact is bent back on itself to form a generally U-shaped bend, said first contact portion comprising the free end portion of said bent outer end, each contact is mounted in a corresponding pocket in said insulative housing, and said pocket includes a supporting wall which supports the outer end of a contact in an area proximate said U-shaped bend when said free end portion is deflected by the leading edge of a printed circuit board inserted in said opening thereby causing such deflection to be localized.

6. In an edge connector of the type having an insulative housing with an opening therein for receiving an edge portion of a printed circuit board, and two series of contacts mounted in opposed relation in said housing for engagement with opposite sides of the leading edge of a board inserted in said opening to make electrical contact with circuitry on the sides of said board, the improvement comprising, in combination, said series of contacts being a plurality of deflectable contacts arranged in opposed pairs, each contact having a first outer contact portion which projects into said opening toward the opposing contact and makes engagement with the adjacent side of the leading edge of a printed circuit board inserted in said opening, the outer end of each contact being bent back on itself to form a generally U-shaped bend and said first contact portion comprising the free end portion of said bent outer end, a second intermediate contact portion which projects into said opening toward the opposing contact and also makes separate engagement from said first outer contact portion with the adjacent side of the leading edge of a printed circuit board inserted in said opening after the leading edge of said board has deflected and moved past said first contact portion, and a third inner contact portion which projects toward the opposing contact, said contacts being formed so that at least the third inner contact portions of an opposing pair of contacts are in engagement in the absence of a board in said opening thereby shorting said contacts until the leading edge of a board has been inserted in engagement with said second contact portions, said bent outer end portions of said contacts being made elongated and sufficiently flexible that insertion of the leading edge of a printed circuit board past said first contact portions will effect only localized deflection of said contacts whereby said third contact portions will remain engaged at least until the leading edge of said board engages and deflects said second contact portions, and said second contact portions being sufficiently proximate said third contact portions that deflection of said second contact portions by the leading edge of a printed circuit board will cause said third contact portions to separate thereby completing a circuit through said board, each contact being mounted in a corresponding pocket in said insulative housing, said pocket including a supporting wall which supports the outer end of a contact in an area proximate said U-shaped bend when said free end portion is deflected by the leading edge of a printed circuit board inserted in said opening thereby causing such deflection to be localized.

* * * * *